United States Patent [19]

Mengel

[11] 4,165,842

[45] Aug. 28, 1979

[54] APPARATUS FOR REPLACING ROTATING MANDRELS ON WHICH A WEB IS WOUND

[75] Inventor: William R. Mengel, Easthampton, Mass.

[73] Assignee: Magnat Corp., Easthampton, Mass.

[21] Appl. No.: 871,591

[22] Filed: Jan. 23, 1978

[51] Int. Cl.[2] ..... B65H 19/14

[52] U.S. Cl. ..... 242/58.3

[58] Field of Search ..... 242/58.1, 58.2, 58.3, 242/58.4, 58.6; 156/502, 504, 507

[56] References Cited

U.S. PATENT DOCUMENTS

| | | | |
|---|---|---|---|
| 2,094,896 | 10/1937 | Knowlton | 242/58.4 |
| 2,745,464 | 5/1956 | Auerbacher | 242/58.4 X |
| 3,194,508 | 7/1965 | Netze | 242/58.3 |
| 3,586,006 | 6/1971 | Wendt | 242/58.4 |
| 3,634,170 | 1/1972 | Hottendorf | 242/58.3 |

*Primary Examiner*—Edward J. McCarthy
*Attorney, Agent, or Firm*—Edgar H. Kent

[57] ABSTRACT

Apparatus for replacing rotating mandrels on which a web is wound, featuring, in various aspects, improved means for accelerating new mandrels to match web speed prior to splicing, gravity-induced movement of the new mandrel between loading and main rotation stations, improved splicing and web severing means, and a temporary web tension control brake associated with a splice roll.

29 Claims, 10 Drawing Figures

FIG 2
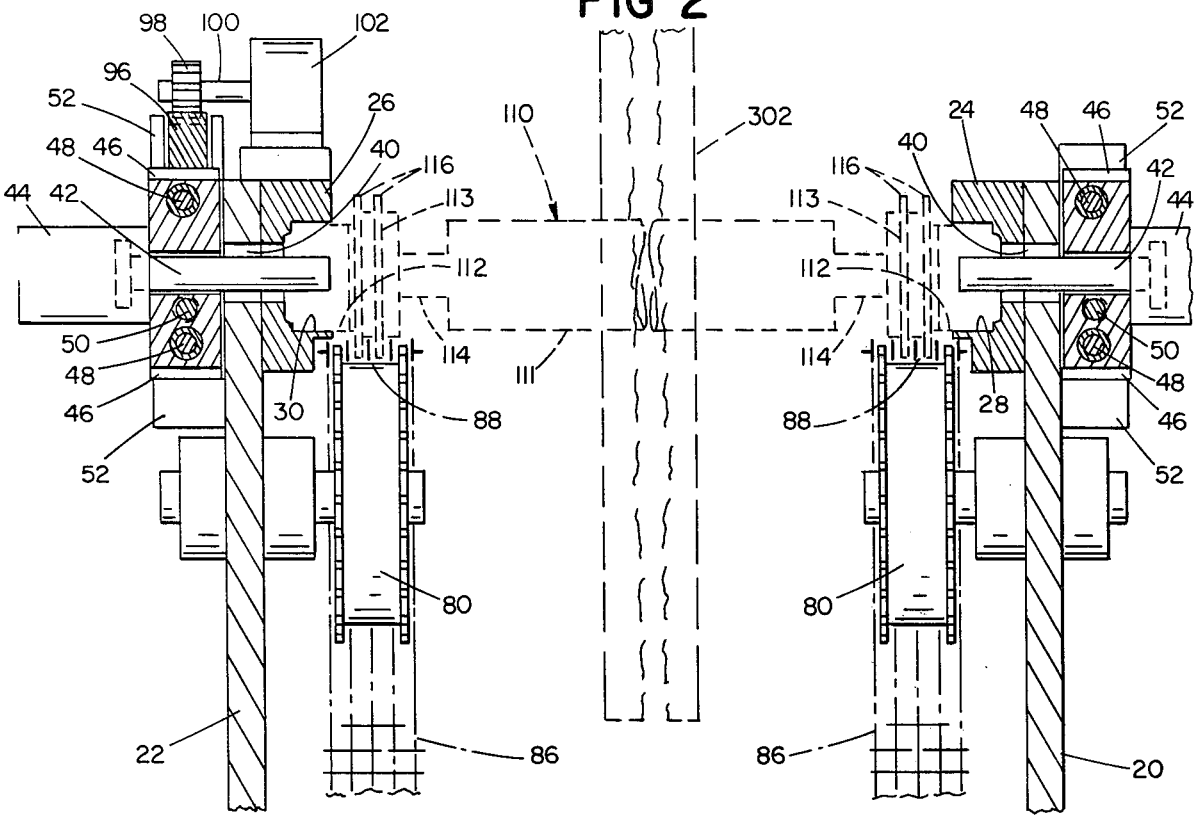
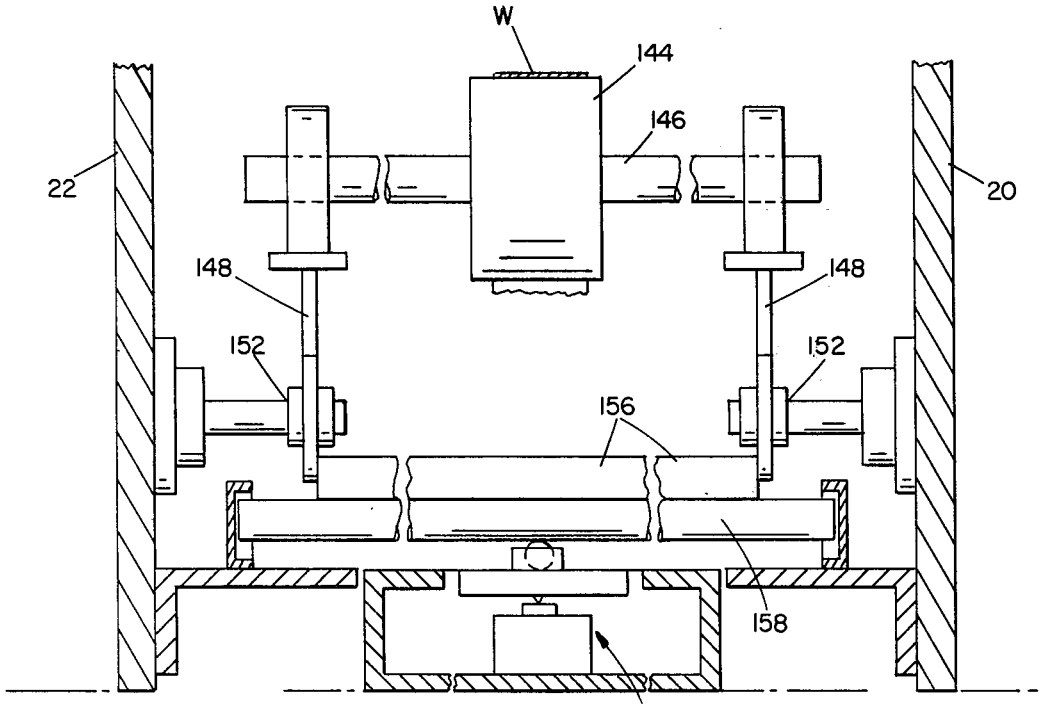
FIG 7

FIG 3
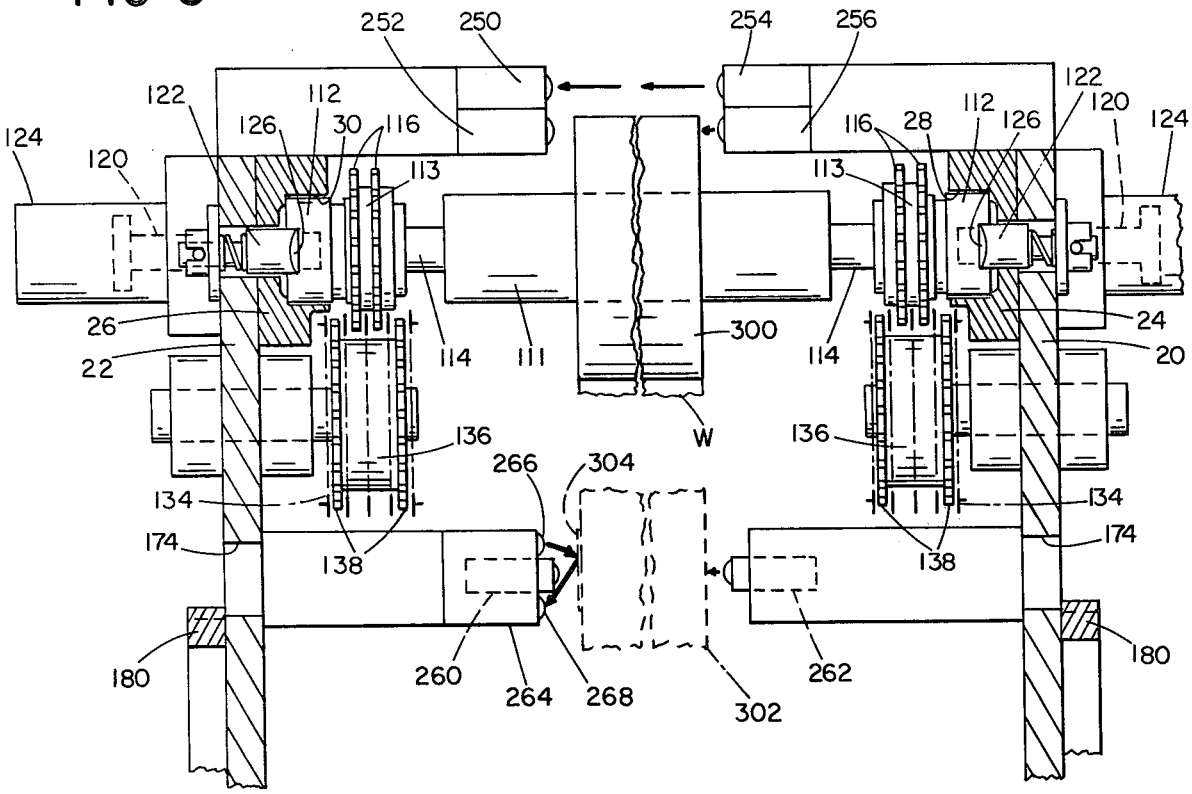
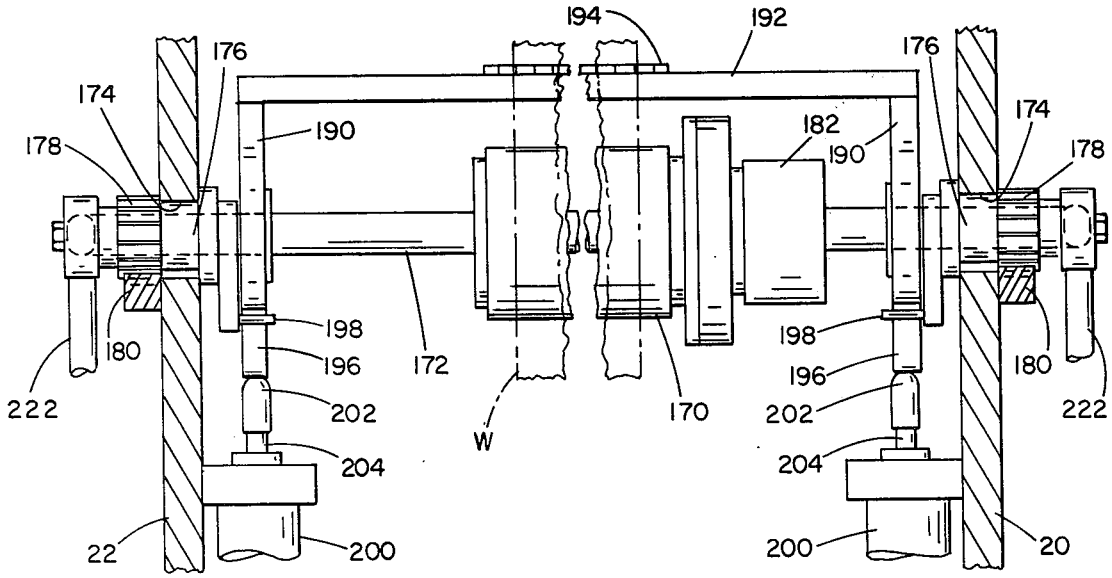
FIG 4

FIG 5
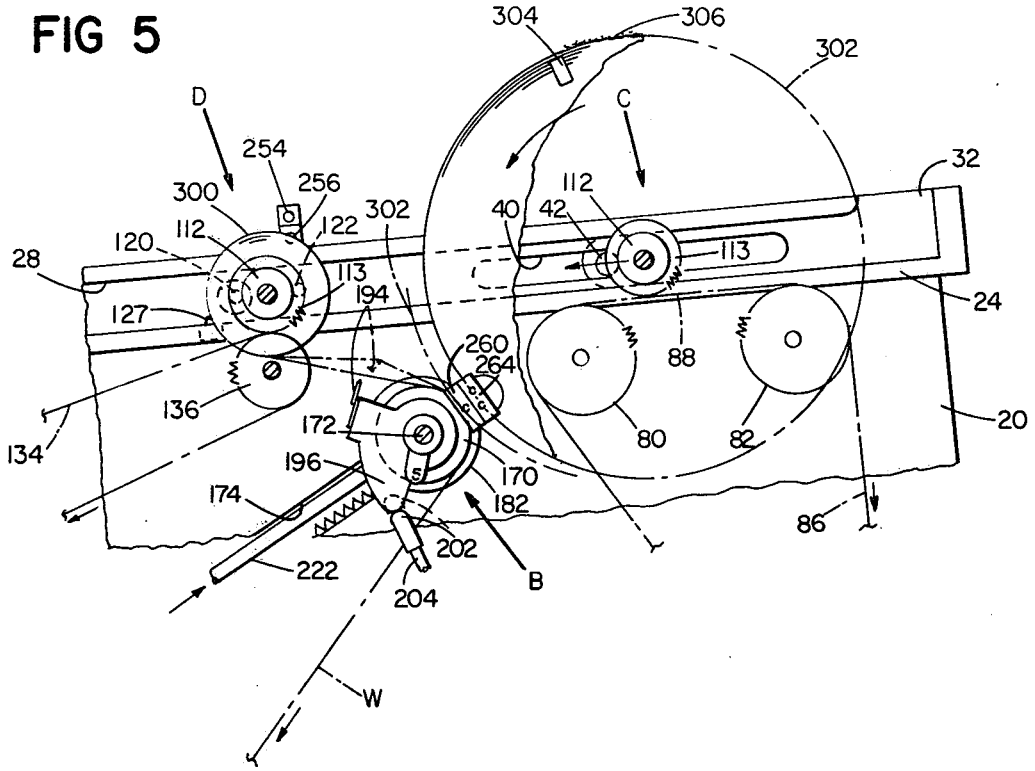
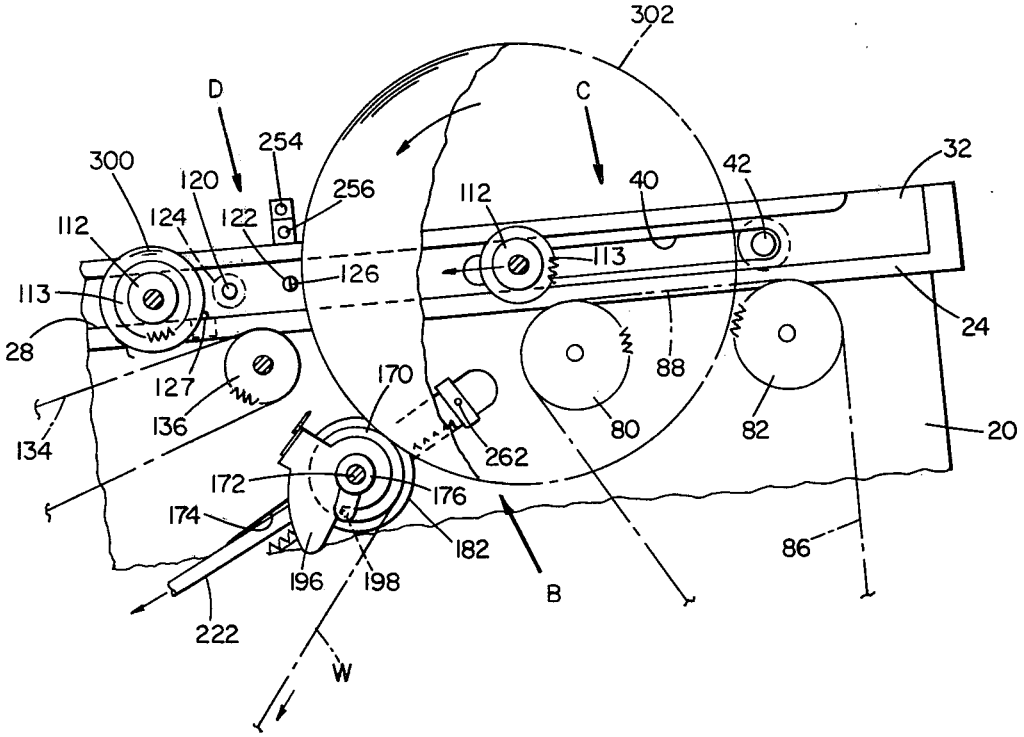
FIG 6

APPARATUS FOR REPLACING ROTATING MANDRELS ON WHICH A WEB IS WOUND

BACKGROUND OF THE INVENTION

This invention relates to apparatus for replacing rotating mandrels on which paper, fabric or other web is wound in a process of applying the web to, or removing it from, a succession of the mandrels. The invention is illustrated and described as applied to an unwinder, in which the web is unwound from the mandrels to be replaced.

Typically such unwinding may be for the purpose of continuously rewinding a succession of mill rolls of the web into smaller rolls for use by the consumer, or to feed a web continuously to web processing machinery.

When successive rolls are to be unwound it is desirable to be able to sever the web from an expiring roll and splice the severed end to the beginning of a new roll, all preferably automatically and without interrupting the unwinding. To avoid a shock on the web, the new roll should be rotating at a peripheral or surface speed equal to that of the expiring roll before the splice is made.

SUMMARY OF THE INVENTION

The invention provides a compact and relatively inexpensive unwinder capable of handling rolls of varying diameters. The cost and complexity of turret systems or web accumulators are avoided. Roll transfer and splicing are carried out without substantial web shock, and with minimum change in the path of the web being unwound. In preferred embodiments the web surface is free of contact with drive belts or the like.

In one aspect the invention features means for supporting a first roll at an unwinding station from which web material is unwound, means for supporting a second said roll at a loading station spaced from said unwinding station, means for moving the second roll over a path between the stations, a new mandrel accelerator located between the stations for rotating and accelerating the second roll to match its peripheral speed to the surface speed of the web unwinding from the first roll, and means for severing the web unwinding from the first roll and splicing the severed web end to the accelerated second roll, the accelerator extending over at least a portion of the path to accommodate rolls of different diameters.

In another aspect the invention features a gravity-induced movement of an incoming mandrel between a loading station and a main rotation station, and means for controlling the gravity-induced movement of the second mandrel along the path. In preferred embodiments, a frame provides a downhill sloping path between the stations to induce the gravity movement, and retractable stop pins movable along the path control the movement of the second mandrel. In yet another aspect a splicing roll is movable between a retracted position and a splicing position adjacent a transfer station, the transfer station being between the loading and main rotation stations and extending over a portion of the path to accommodate (in an unwinder) web rolls of different diameters, and sensing means are provided to initially position the second mandrel at the transfer station just short of a nip with the splice roll. In yet other aspects of the invention a web severing knife is movable with the splice roll and a knife actuator is permanently mounted at the splicing position; a main tension control brake is provided at the main rotation station, and a further brake is associated with the splice roll to control web tension while the web is engaged with the splice roll before the second roll moves to the main rotation station; and (in an unwinder) means automatically responsive to the diameter of a web roll on the second mandrel are provided to control the speed of the accelerator.

BRIEF DESCRIPTION OF THE DRAWINGS

FIG. 2 is a sectional view, partly broken away, taken along 2—2 of FIG. 1, with a new wound mandrel being loaded shown in dashed lines.

FIG. 3 is a sectional view taken along 3—3 of FIG. 1, with a new wound mandrel ready to be spliced shown in dashed lines.

FIG. 4 is a sectional view taken along 4—4 of FIG. 1, with the splice roll advanced to its splicing position.

FIG. 5 is a somewhat diagrammatic side view similar to FIG. 1 but showing only a portion of the apparatus having to do with splicing, the movement of the new mill roll and the knife during the splicing operation being indicated by dashed line positions.

FIG. 6 is a view similar to FIG. 5, but with the splice having been completed and the splice roll partially retracted.

FIG. 7 is a somewhat diagrammatic sectional view, partly broken away, taken along 7—7 of FIG. 1.

DESCRIPTION OF THE PREFERRED EMBODIMENT

Figure 1:
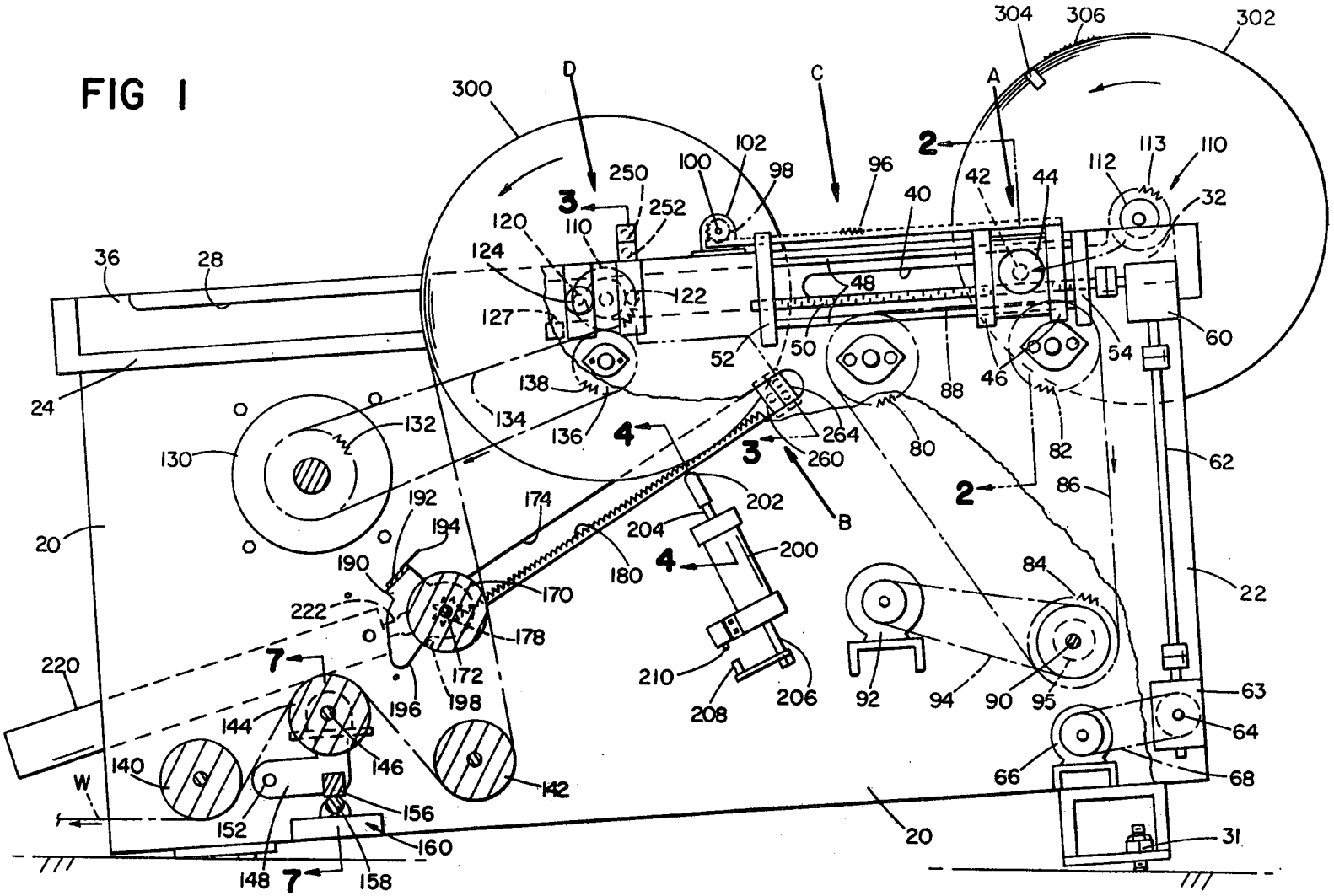
FIG. 1 is a side view partly broken away and sectioned of unwinding apparatus embodying the invention.

Referring to the drawings, vertical side plates 20, 22 each have along their upper edges a guide 24, 26 providing an inwardly opening channel 28, 30. Adjustable members 31 tilt the machine so that channels 28, 30 extend longitudinally at about 4° to the horizontal. Each guide 24, 26 is relieved at its raised end to the depth of its channel to provide a channel entrance 32 and each channel has a similar exit 36.

Except where otherwise indicated in the text or shown in the drawings, the following further description of side plate 20 and the elements associated with it applies equally to plate 22 and corresponding elements associated with it.

Plate 20 and guide 24 are longitudinally slotted at 40 to admit the end of horizontal rod 42 of pneumatic cylinder 44 supported outside the plate by brackets 46 and the rods 42 when projected form stop pins engaging the mandrel of an incoming web roll. The brackets are mounted to slide parallel to slot 40 on rods 48. Control rod 50 is journalled at opposite ends in stationary brackets 52, 54, and has a central threaded portion engaged with threaded openings in brackets 46 so that rotation of the control rod will move piston rod 42 along slot 40. Rod 50 is coupled through right angle bevel gear box 60, rod 62, and a second gear box 63, to shaft 64, which extends horizontally to the corresponding gear box associated with plate 22. Shaft 64 is driven by a single motor 66 (½ horsepower AC, #P56G46 Reliance Electric Company, 24701 Euclid Ave., Cleveland, Ohio 44117) through timing belt 68, the motor being provided with a brake for rapid stopping.

Mounted for rotation on the inside of plate 20 are idler sprocket wheels 80 and 82, and a driven sprocket wheel 84. Each sprocket wheel has two rings of teeth to mesh with the outside strands of four strand roller chain 86, which extends along linear path 88 between idlers 80 and 82 parallel to and beneath slot 40. Drive shaft 90 extends between driven sprocket wheel 84 and the corresponding sprocket wheel inside plate 22. Shaft 90 is driven by variable speed motor 92 (1 horsepower DC, Reliance Electric Company T5603202) through timing belt 94 and pneumatic clutch 95.

On one side of the machine only, a rack 96 is mounted on brackets 46 and meshes with a pinion gear 98 fixed on the shaft 100 of a potentiometer 102 supported on plate 22. The potentiometer is wired through control circuitry to set the speed of motor 92 in accordance with the longitudinal position of piston rod 42 in slot 40.

The machine is designed for use with rolls wound on mandrels 110 (FIGS. 1 and 2). The mandrel has a central web-carrying portion 111, a ball bearing roller 112 at each end, and a sprocket wheel 113 just inward of each roller. Each wheel 113 is keyed to the mandrel shaft 114, and has two rings of teeth 116 spaced to mesh with the inner two strands of a chain 86.

Beyond slot 40 in guide 24 are mounted horizontal, retractable stop pins 120 and 122, spaced apart by slightly more than the diameter of mandrel rollers 112. Each pin extends through an opening into channel 28. Pin 120 is controlled by pneumatic cylinder 124. Pin 122 is spring loaded in its extended position, and has a bevelled end 126 facing upstream to be struck by a mandrel roller 112 moving along channel 28 to force it to retracted position. Limit switch 127 is located in channel 28 just beyond pin 120.

Web tension control air operated disc brake 130 (#704 sold by Montalvo Corp., 200 Riverside Industrial Park, Portland, Maine) is mounted inside plate 20 and is coupled via sprocket wheel 132 and four strand roller chain 134 to sprocket wheel 136. Wheel 136 has two rings 138 of teeth spaced to engage outer strands of chain 134 while supporting the chain so that its inner strands engage the teeth of mandrel sprocket wheel 113.

Web idler rolls 140 and 142 extend between plates 20 and 22 at the lower end of the machine. Between and slightly above the idler rolls is mounted a web tension control roll 144, its shaft 146 journalled in and extending between trunnions 148 pivoted at 152 to side plates 20 and 22 (FIGS. 1 and 7). Cross bar 156 also extends between the trunnions, and bears against roller 158 mounted on top of air-operated force transducer 160. Transducer 160 (from PA Industries, Bloomfield, Conn.) measures the force with which bar 156 bears against roller 158, and provides a pneumatic output which ultimately controls the setting of web tension control brake 130.

Splice roll 170 is mounted on shaft 172, the ends of which extend through oblique slots 174 in plates 20 and 22 and are arranged to slide along said slots on bushings 176 (FIGS. 1 and 4). The ends of shaft 172 outside the side plates 20 and 22 carry pinions 178 that mesh with racks 180 secured to the plates along the lower edges of the slots 174. Pneumatic brake 182 (Horton Air Champ Light Weight Clutch, from Horton Mfg. Co., Inc., 1170 13th Ave. S.E., Minneapolis, Minn.) is mounted to restrain rotation of splice roll 170 about shaft 172.

Pivotally mounted on shaft 172 are arms 190 between which extends cross bar 192 carrying web severing knife 194. Lobes 196 of arms 190 rest against stop pins 198 carried by bushings 176, and, by gravity, bias the knife counterclockwise about shaft 172 in a retracted position pointing upwardly and to the right as seen in FIG. 1.

Near the upper end of slot 174 a knife-actuating pneumatic cylinder 200 is mounted on plate 20, and has a rounded nose 202 on its rod 204 arranged to strike against arm lobe 196 to forceably pivot arms 190 and knife 194 clockwise when cylinder 200 is actuated. The cylinder has a double rod piston, and rear rod 206 carries a pin 208 to contact limit switch 210 after the cylinder is actuated to reverse its action.

Pneumatic cylinder 220 is mounted on plate 20 and has its rod 222 connected to the outer end of shaft 172 through a spherical bearing, for moving shaft 172, and with it the splice roll and knife, along slots 174.

Vertically spaced photoelectric sensors 250, 252 are mounted inside plate 22 in the region above pins 120 and 122, with respectively aligned light sources 254 and 256 mounted across the machine inside plate 20 (FIGS. 1 and 3). This and other photoelectric systems used in the preferred embodiment are LED scanners from Banner Engineering Corp., 9714 10th Avenue North, Minneapolis, Minn.

Photoelectric sensor 260 is mounted inside plate 22 near the upper end of slot 174 and is aligned with light source 262 across the machine on plate 20. Also mounted on plate 22, near sensor 260, is a retroreflective assembly 264, consisting of light source 266 and photoelectric sensor 268 arranged so that light originating at source 266 and reflected back toward eye 264 will impinge upon sensor 268.

Operation of the machine to replace an unwound roll 300 with a new roll 302 is as follows.

New roll 302 is loaded into the machine by passing its mandrel rollers 112 through channel entrances 32 into channels 28, 30, rollers 112 then rolling by gravity along channels 28, 30 until they are stopped by engagement with stop pins 42 at loading station A. The drawings contemplate new roll insertion by other manually controlled equipment not shown, such as a hoist which lowers the roll 302 through entrances 32, roll 302 being shown in FIG. 1 partially inserted in the entrances. Automatic loading from a magazine formed by extending channels 28, 30 far to the right in FIG. 1 is feasible, but the rolls are normally so large and are so long in unwinding that individual loading, as compared with less frequent loading of a magazine, is not unduly burdensome, so as to justify the space and expense of the magazine. Loading of new roll 302 to position A takes place before the working roll 300 has been unwound sufficiently to expose sensor 250 to its activating light source 254.

A manual control is provided for activating light sources 254 and 256 and their sensors 250, 252 by the machine operator when the working roll 300 diameter is approaching sensor 250, automatic controls being provided for turning them off and for activating and deactivating the other such sources and sensors at the appropriate times as hereinafter described.

Activation of the operating source 254 of expiring roll sensor 250 also activates source 256 for sensor 252 and turns on a splice light in a control panel (not shown). Sensor 250 is electrically connected to produce the following operations automatically when working roll 300 is unwound sufficiently to expose it to its source 256:

250-1. Activate pneumatic cylinder 220 to advance splice roll 170 and associated knife 194 from the retracted position of FIG. 1 to the operating position designated B in FIG. 1 and shown in FIG. 5, moving against the unwinding web W to change its path as indicated in the comparison of FIG. 5 with FIG. 1;

250-2. Through a time delay connection, activate light source 262 and its sensor 260 (FIG. 3);

Sensor 260, when activated by source 262, is electrically connected to:

260-l. Activate positioning motor 66 to advance stop pins 42 from the A position of roll 302 in FIG. 1, roll 302 following, rolling on its rollers 112, until roll 302 reaches C position interposed between sensor 260 and source 262, deactivating motor 66;

and when de-activated by arrival of roll 302 at position C is electrically connected to:

260-2. Activate accelerator motor 92 to drive chains 86 (FIG. 2) in the clockwise direction in FIG. 1 and thereby through engagement of mandrel sprocket wheels 113 with chains 86, rotate roll 302 in the counterclockwise direction in FIG. 1;

260-3. Activate control circuitry which terminates acceleration of motor 92 at a speed, thereafter maintained constant, at which the linear speed of web W unwinding from working roll 300 matches the accelerated peripheral speed of incoming roll 302. (The preferred embodiment utilizes for this purpose the commercially available Reliance Accelerator Drive of Reliance Electric Co. aforesaid which modifies a voltage signal from a web speed detector, located, e.g., on a following rewinding machine, according to voltage from potentiometer 102 indicative of roll 302 diameter (which may be multiplied by $\pi$ for roll periphery) to operate an accelerator stop when the motor speed, and the voltage from a tachometer measuring it, have reached the proper level.)

When roll 300 is unwound almost to its core it allows light from source 256 to reach sensor 252, actuating the latter to cause it, through its electrical connections to:

252-1. Turn on source 266 and sensor 268;

252-2. Deactivate sources 254, 256 and 262 and their corresponding sensors 250, 252 and 260.

Sensor 268 is arranged to receive activating reflection, from a reflective tape 304 on the adjacent end of roll 302 (FIG. 1), of the beam from source 266. On the first pass of reflective tape 304 through its position reflecting the beam from source 266 to sensor 268, sensor 268 is electrically connected to:

268-1. Cause cylinders 44 to retract stop pins 42 from the path of roll 302 core rollers 112. Retraction of pins 42 allows rollers 112 on core roll 302 mandrel 110 to rotate under the force of gravity, carrying roll 302 from its C position to its position nipping web W against splice roll 170, shown by the partial dash line 302 in FIG. 5.

The next pass of tape 304 through its position activating sensor 268 causes:

268-2. Operation of knife actuating cylinders 200 to force the knife 194 clockwise through its position severing the unwinding web W, indicated by the dashed line web position in FIG. 5. A tape 306 (FIGS. 1 and 5) with a sticky exposed surface is attached to the free end of the web of roll 302 with tape 304 positioned relative thereto so that tape 306 is opposite the portion of web W extending from splice roll 170 to the point of severance of web W by the knife, so that the free end of the severed web W and sticky tape 306 are forced and adhered together as they mutually pass through the nip between splice roll 170 and incoming roll 302, effecting the splice so that the web is now unwinding from roll 302 (FIG. 6) which is rotated by motor 92 at a peripheral speed matching the linear speed of the web when severed as previously explained.

268-3. Activation of splice roll brake 182 to apply preset braking force to the roll and thereby tension the web while web tension control via brake 130 is not in operation.

268-4 Activation of an auxiliary control of brake 130 which applies sharply increased braking force to stop movement of chains 134.

Actuation of the knife closes limit switch 210 (FIG. 1) in circuitry which:

210-1 Retracts stop pins 120 from the path of the core of expired roll 300 so that the core is free to roll by gravity to the end of channels 24, 28 for removal through outlet 36.

210-2 Reverses the control of cylinder 200 so that the knife actuating mechanism connected to its piston retracts after completion of the cut.

210-3 Turns off motor 92 and disengages clutch 95 so that chains 86 can run freely and web tension takes over rotation of roll 302 to accommodate any slight mismatch that may have occurred between the linear speed of the unwinding web at the moment of splice and the peripheral speed of roll 302 produced by control of motor 92 as previously explained.

210-4 Deactivates photocell 266 and tape sensor 268.

The core of expired roll 300, released by retraction of stop pins 120 to roll over limit switch 127, actuates switch 127 (FIG. 1) which is electrically connected to effect the following:

127-1 Partial release of brake 130 so that chain 134 is only slightly restrained.

127-2 Restoration of pins 120 to position to stop the core of incoming roll 302.

127-3 Operation of cylinder 220 to retract splice roll 170 and knife 194 to FIG. 1 position, roll 302 following by gravity rolling on its core rollers from its FIG. 6 position into the position against stop pins 120 vacated by the core of expired roll 300, since roll 302 stop pins 42 have been retracted (268-1 above), roll 302 maintaining nip of its web against splice roll 170 during this movement and its core sprocket wheels 113 rolling off accelerator chain 88 and onto brake chain 134, now free running to facilitate mesh of the sprocket wheels with chain 134 (127-1 above).

Retraction of splice roll 170 causes, by limit switches (not shown):

127-3-1 Reverse actuation of motor 66 and advance of stop pins 42 to restore the pins to their FIG. 1 position and stopping the motor.

127-3-2 Deactivation of roll 170, brake 182, and restoration of control of brake 130 by transducer 160.

Roll 302 is now in the working position of roll 300 in FIG. 1 and the replacement operation has been completed.

Special controls are provided for inserting an initial roll into working position in the apparatus, either when there is no working roll 300 therein or when it is desired to replace such roll with another roll without making a splice, using part only of the mechanisms and controls used in replacement with splice.

In such case, if there is a roll 300 in the working position its end leading to the equipment served by the apparatus is removed and the web tensioning controls are deactivated. When the roll to be inserted has been loaded to position A in FIG. 1, an operator presses a push button switch electrically connected to cause, either directly, or through rearrangement of circuits:

PBS-1. Retraction of stop pins 120 so that a working roll 300, if present, will roll out of working position for removal through channel exit 36.

PBS-2. Actuation of cylinders 220 to advance splice roll 170 to its FIG. 5 position where it will stop the incoming roll and guide it into operating position.

After advance of the splice roll:

PBS-3. Operation of motor 66 to advance stop pins 42 until the new roll reaches position C, then retracting these stop pins so that the new roll moves on its rollers into contact with splice roll 170.

PBS-4. Return of pins 120 to advanced, stop position.

PBS-5. Retraction of splice roll 170, thus allowing the new roll to roll into working position against stop pins 120.

PBS-6. Advance of stop pins 42 and operation of motor 66 to return them to starting position.

The material of the new roll is now hand-threaded through the tensioning rolls to the following equipment, tension brake 130 being disabled (along with other mechanisms not operated in the above sequence) to permit free rolling of the new roll in its bearings to unwind it during hand threading.

The electrical operating and sequencing control circuitry for the machine may be readily provided, utilizing either entirely conventional electrical circuit components such as wires, switches, relays, solenoids, or a programmable computer controller with functionally equivalent input and output terminals and program instructions. In the preferred embodiment, applicant utilizes such a controller, the Automate (Registered Trademark) 31 Programmable Controller of Reliance Electric Co. aforesaid.

Figure 8:
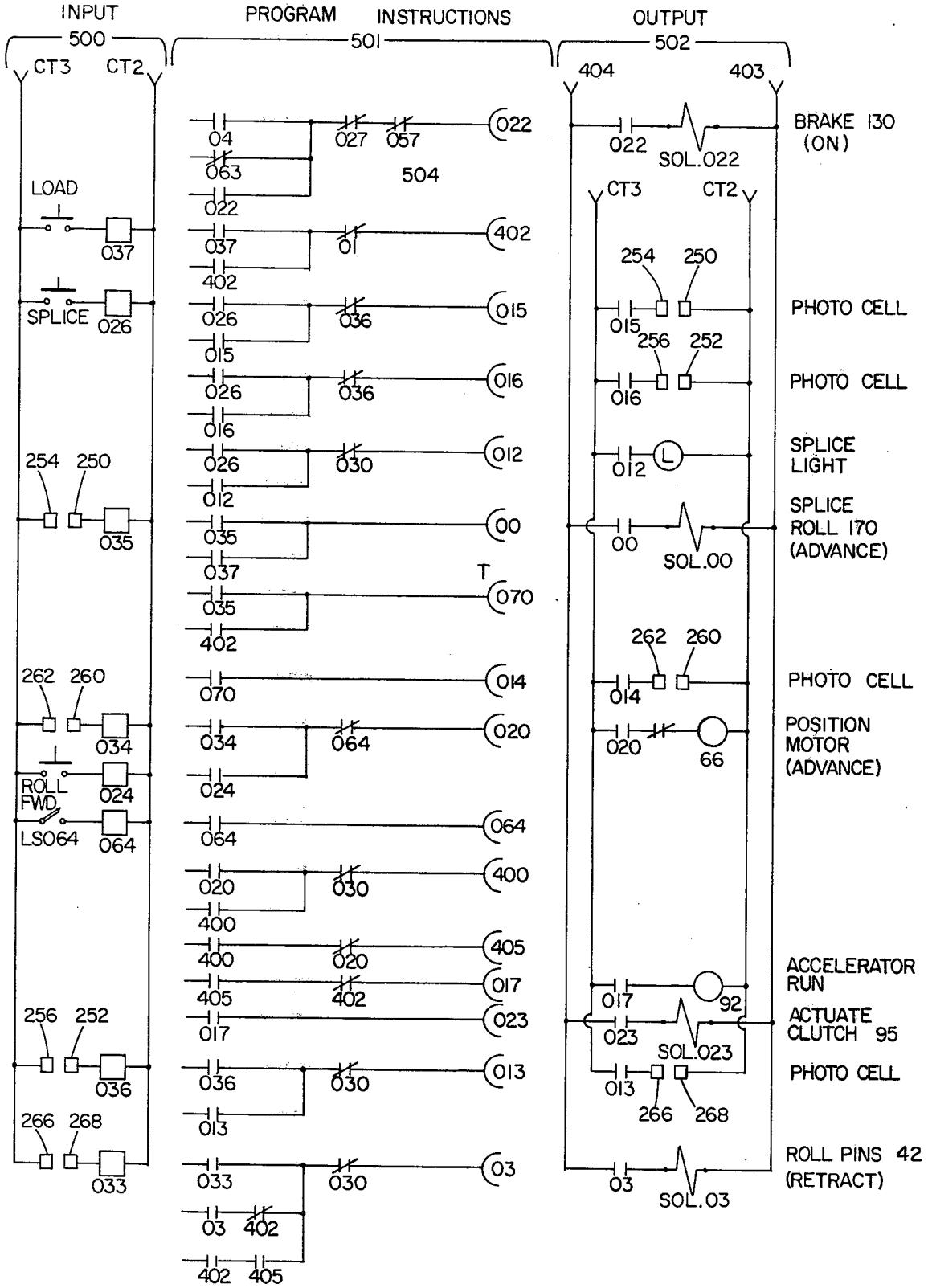
FIGS. 8 and 9 are diagrammatic views illustrating electrical operating and sequencing control circuitry for the apparatus.
Figure 9:
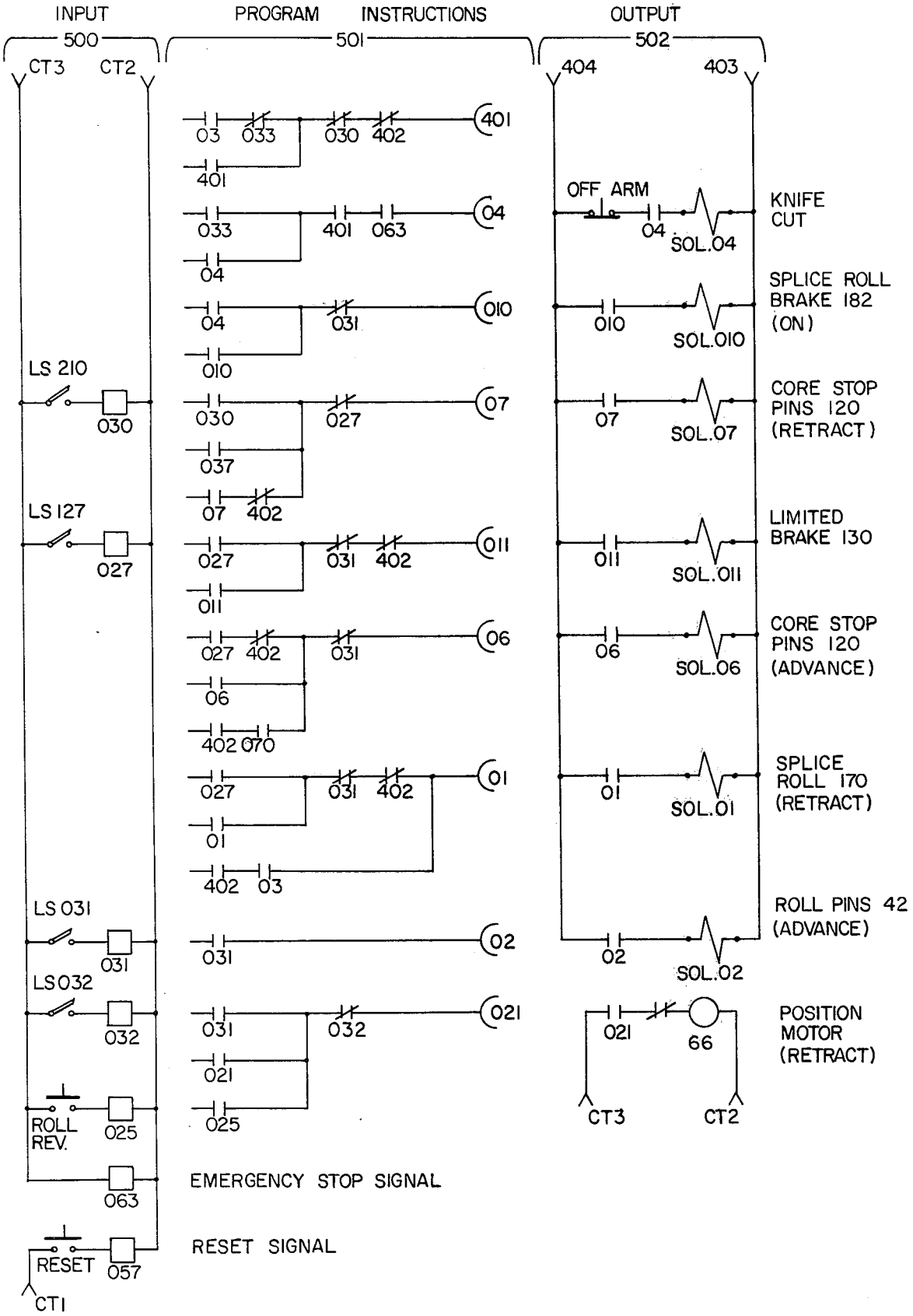

FIGS. 8 and 9 diagrammatically illustrate operating and sequencing control circuitry designed for use with the programmable controller of the preferred embodiment. Computer input components, program instructions, and output components for the controller are grouped into three columns 500, 501, 502, respectively, in each of FIGS. 8 and 9, with FIG. 9 following FIG. 8 in sequence.

In input section 500 at the left, the two vertical lines CT3 and CT2 represent 110–115 volt AC power lines. The circuits between the power lines provide inputs to the controller. The actual operating controls on the machine and operating console are indicated at the left by numbers from the machine drawings (FIGS. 1–7) and/or by legends. Computer input terminals are indicated at the right by numbered boxes, the numbers corresponding with physical terminals on input/output cards of the Automate 31. Each computer input terminal and its function correspond to the coil of a solenoid-operated switch that opens or closes switch contacts of the same number indicated in the program instructions 501.

Program instructions 501 are written in the form of logic circuits each composed of numbered electrically-connected switch contacts, shown either normally open or normally closed by conventional symbols. Each logic circuit terminates in an "internal" output, represented by a semi-circle containing a number. An internal output is energized when a "circuit" is completed from left to right by closed switch contacts. Each internal output is electrically equivalent to the coil of a solenoid-operated switch that opens or closes switch contacts of the same number either in the program instructions or in output section 502.

In output section 502 at the right, the two 404, 403 lines represent 110–115 volt AC power lines, as do lines CT3 and CT2, which are used in some instances. The circuits between the power lines connect the output terminals of the controller, indicated by numbered switch contacts, with the various machine components and controls, indicated by legends and numbers from the machine drawings. Each output terminal corresponds with a physical terminal on an input/output card of the Automate 31, and is electrically equivalent to switch contacts closed when the same number internal output is energized.

All switches with the same number are operated (i.e., normally open switches are closed and normally closed switches are opened) by the control (input terminal or internal output) of the same number.

For a replacement operation, the pushbutton switch labelled "SPLICE" (FIG. 8, left) is depressed to energize input terminal 026 which functions as if it:

closes switch 026 immediately to its right, energizing internal output 015 which functions as if it closes switch 015 in a by-pass circuit to its left thereby energizing output 015 independently of the splice switch, and operates switch 015 in the circuit to its right activating photocell source 254 and its sensor 250;

closes switch 026 in the next lower circuit in section 501, energizing internal output 016 which similarly functions as if it closes switch 016 in a by-pass circuit and operates switch 016 to its right to activate photocell light source 256 and its sensor 252;

closes switch 026 in the second lower circuit in section 501 energizing internal output 012 which functions as if it closes switches 012 in a by-pass circuit and in panel splice light L activating circuit.

When exhaustion of working roll 300 exposes sensor 250 to source 254, the circuit energizes FIG. 8 input terminal 035 which functions as if it:

closes switch 035 to its right energizing internal output 00 which in turn functions as if it closes switch 00 to its right in the operating circuit of a solenoid 00 that switches a valve controlling cylinder 220 to cause the cylinder to advance the splice arm with splice roll 170 and knife 194 as described in paragraph 250-1 above;

closes switch 035 in the next lower circuit energizing internal output 070 that functions as if it were a time delay relay indicated by "T" which, after the delay, closes switch 070 in the circuit immediately below to energize internal output 014 that functions as if it closes switch 014 in the circuit to its right of photocell 262 and sensor 260, activating that circuit as described in paragraph 250-2 above.

Closing the photocell 262-sensor 260 circuit energizes FIG. 8 input terminal 034 which functions as if it closes switch 034 immediately to its right to energize internal output 020 which functions as if it:

(a) closes switches 020 to its right to effect advance operation of motor 66 (through an unnumbered switch of an interlock circuit with a like switch in the motor retract circuit described below to prevent accidental simultaneous operation of both circuits), so that motor 66 advances pins 42 and new roll 302 until roll 302 reaches C position, cutting off the light of photocell 262 to sensor 260 and the circuit therethrough, stopping motor 66, as described in paragraph 260-1 above (a manual switch shown under photocells 262–260 at the left hand side of FIG. 8, providing an alternative manual control of motor 66, with a limit switch LS064 ( on the machine but not shown in the machine drawings) which energizes input terminal 064 to function as if it closes switch 064 to its right, energizing internal output 064 to function as if it opened a switch 064 in the energizing circuit of internal output 030 above it to prevent manual controlled advance of stop pins 42 by motor 66 beyond the limit position of the switch);

(b) closes switch 020 in the circuit to its left via closed switch 030 to energize internal output 400 which in turn functions as if it closes switch 400 in the next lower circuit to energize internal output 405 via normally closed switch 020, held open via internal output 020 above it so long as the photocell circuit 262–260 is active;

(c) when photocell circuit 262–260 is broken by interposition of roll 302 at position C, switch 020 in the circuit to internal output 405 closes, that output functioning as if it closes switch 405 in the next lower circuit which, through closed switch 402, energizes internal output 017 which functions as if it closed switch 017 to its right activating accelerator drive motor 92 and its controls and closes switch 017 in the next lower circuit energizing internal output 023 to function as if it closes switch 023 to its right activating solenoid 023 to engage clutch 95 so that chains 86 are driven by motor 92 and incoming roll 302 is rotated and accelerated to a peripheral speed matching the linear speed of the web, as described in paragraph 260-2 and 260-3 above.

When the nearly complete exhaustion of the web from working roll 300 exposes sensor 252 to source 256, the circuit energizes input terminal 036 of FIG. 8 which functions as if it:

closes switch 036 in the circuit immediately to its right energizing internal output 013 which functions as if it closes switch 013 in the by-pass circuit to its left so that it will remain active until normally closed switch 030 also included is opened, and closes normally open switch 013 in the photocell 266-sensor 268 circuit to its right, activating the circuit, as described in paragraph 252-1 above;

opens switches 036 in two of the splice button switch controlled circuits above it in FIG. 8, deactivating source-sensors 254-250 and 256-252 and also 262-260 which is maintained operative by 254-250, as described in paragraph 252-2 above.

On the first pass of the reflective tape 304 through position reflecting light from source 266 to sensor 268 the so-established circuit energizes FIG. 8 input terminal 033 to function as if it closes switch 033 in the circuit to its right through closed switch 030 to energize internal output 03, opens switch 033 in the uppermost circuit in FIG. 9 to internal output 401 and closes switch 033 in the next lower FIG. 9 circuit to internal output 04.

Internal output 03 (FIG. 8) functions as if it:

closes switch 03 in the by-pass circuit through closed switches 402 and 030 so that it remains active until switch 030 is opened;

closes switch 03 in the circuit to its right operating solenoid 03 to shift the control valve on the fluid flow to cylinders 44 to retract stop pins 42, so that roll 302 rolls to nip splice roll 170, as described in paragraph 268-1 above;

closes switch 03 in the top circuit of FIG. 9 to energize internal input 201 which acts, when interruption of the photocell 266–268 circuit closes switch 033, as if it closes switch 401 in the by-pass circuit to its left latching itself on until normally closed switch 030 is opened, and closes switch 401 in the next lower FIG. 9 circuit through switch 063 (shown normally open but closed when the operating current to the machine is on as here, see Emergency Stop Signal at bottom of FIG. 9) to internal output 04 which, however, is not energized because its switch 033 was opened by interruption of the 266–268 photocell circuit to input terminal 033 which closed it.

On the next pass of the reflective tape 304 its energization of input terminal 033 again acts as if it closes switch 033 in the circuit to internal output 03 and opens switch 033 in the circuit to internal output 401, without effect, however, because both these outputs have latched on through their bypass circuits. In addition input terminal 033 agains closes switch 033 in the FIG. 9 circuit to internal output 04 which is effective this time to energize internal output 04, since internal output 401 has meanwhile closed its switch 401. Internal output 04 functions as if it:

closes switch 04 in the by-pass line to its left, latching itself on;

closes switch 04 in the circuit to its right through a manual emergency stop switch to solenoid 04 which shifts the control valve for fluid flow to knife actuating cylinders 200, operating the knife as described in paragraph 268-2 above;

closes switch 04 in the next lower circuit through switch 031 to energize internal output 010 which functions as if it closes switch 010 in the by-pass circuit to its left latching itself on until switch 031 is opened, and closes switch 010 in the circuit to its right operating solenoid 010 which activates splice roll brake 182, as described in paragraph 268-3 above;

closes switch 04 in the top circuit of FIG. 8 through closed switches 027 and 057 to energize internal output 022 which functions as if it closes switch 022 in the by-pass circuit to its left, latching itself on until swith 027 is opened (switch 063 in the alternate by-pass circuit is open since the current is on), and closes switch 022 to its right, activating solenoid 022 which operates brake 130 to stop roller chains 134, as described in paragraph 268-4 above;

On operation of the knife, limit switch 210 on its operating mechanism is closed energizing input terminal 030 which functions as if it:

closes switch 030 in the circuit to its right energizing internal output 07 which in turn functions as if it closes a switch 07 in a by-pass circuit to its left through closed switches 402 and 027, latching itself on until switch 027 is opened, and closes a switch 07 in the circuit to its right operating solenoid 07 which switches a fluid flow control valve to cylinders 124 of core stop pins 120, retracting the pins so the core of exhausted roll 300 can roll out, as described in paragraph 210-1 above;

opens switch 030 in the top circuit of FIG. 9 with the effect of de-energizing internal output 401 thereby opening switch 401 in the next lower circuit to internal output 04, deactivating knife-operating solenoid 04 which returns to pressure exhaust position, allowing the knife and operating mechanism to retract by gravity as described in paragraph 210-2 above;

opens switch 030 in the FIG. 8 circuit to internal output 400, stopping accelerator motor 92 and disengaging its clutch 95 so chains 86 are free running as described in paragraph 210-3 above;

opens switches 030 in the FIG. 8 circuits to internal outputs 03, 013, and 012, deactivating, respectively, pin 42 retraction solenoid 03, photocell circuit 266-268, and the splice light.

The released core of roll 300 rolls over and closes limit switch 127 energizing input terminal 027 which functions as if it:

closes a switch 027 in the circuit immediately to its right energizing, through closed switches 031 and 402, internal output 011 which, in turn, acts as if it closes switch 011 in the by-pass circuit to its left, latching itself on until switch 031 is opened;

opens a switch 027 in the top circuit on FIG. 8 deactivating solenoid 022 control of brake 130, and by its energization of FIG. 9 internal output 011, functioning as if it closes switch 011 to its right, activating solenoid 011 to reduce braking force on brake 130 so that chains 134 may have lightly restrained movement as the new roll 302 sprockets engage it, facilitating meshing, as described in paragraph 127-1 above;

closes a switch 027 to energize, through closed switches 402 and 031, FIG. 9 internal output 06, which functions as if it closes switch 06 in a by-pass circuit to its left, latching itself on until switch 031 is opened, and closes a switch 06 to its right activating solenoid 06 operating the control valve to cylinders 124 to return pins 120 to stop position, as described in paragraph 127-2 above;

closes a switch 027 to energize, through closed switches 031 and 402, FIG. 9 internal output 01 which functions as if it closes switch 01 in the by-pass circuit to its left, latching itself on until switch 031 is opened, and closes switch 01 to its right activating solenoid 01 operating cylinder 220 to retract splice roll 170 to its FIG. 1 position, as described in paragraph 127-3 above.

Retraction of splice roll 170 closes a limit switch (not shown in the machine drawings, designated "LS031" on FIG. 9) which energizes input terminal 031 to function as if it:

closes switch 031 immediately to its right, energizing internal output terminal 02 to function as if it closes switch 02 to its right, operating solenoid 02 to shift the control valve of cylinder 44, returning pins 42 to stop position, and closes switch 031 in the circuit below it to energize, through closed switch 032, internal output 021 which functions as if it closed switch 021 in a by-pass circuit to its left, latching itself on until switch 032 is opened and closes switch 021 in the circuit to its right, which, through an unnumbered switch in an interlock circuit with a like switch in the "Accelerator Run" circuit on FIG. 8 described above, operates motor 66 to retract stop pins 42 to starting position, as described in paragraph 127-3-1 above;

opens switches 031 in the energizing circuits of FIG. 9 internal outputs 010, 011, 06 and 01, thereby terminating their functions.

Last, retraction of stop pins 42 to initial position actuates a limit switch (not shown in the machine drawings, designated "LS032" on FIG. 9) which energizes input terminal 032 to function as if it opens switch 032 in the circuit to its right, de-energizing internal control 021 and stopping motor 66. A manual switch "Roll Rev." enables alternative manual control of the retraction operation of motor 66 via input terminal 025, which functions as if it closes switch 025 in the by-pass circuit to its right energizing internal output 021 to function as if it closed switch 021 in a by-pass circuit to its left, latching itself on until closed switch 032 is opened by limit switch LS032, and closes switch 021 to its right to operate motor 66.

When it is desired to load a new roll 302 into the machine without splicing (i.e., when there is no working roll 300 in the machine or where such a roll inactive in the machine is to be replaced with another roll, for example, of a different web), the preferred control system of FIGS. 8 and 9 operates as follows.

A manual "RESET" switch indicated at the bottom of FIG. 9 is operated to energize input terminal 057, the function of which, labeled "RESET SIGNAL," is, in effect, to open a switch 057 in the top circuit of FIG. 8 that applied brake 130, thus momentarily opening the circuit to deenergize it if it is for any reason latched on.

With the new roll at load position in the machine, a manual switch labelled "LOAD" (FIG. 8, top left) is operated to energize input terminal 037 which functions as if it:

closes switch 037 to its right, energizing, through closed switch 01, internal output 402 to function as if it closed switch 402 in a by-pass circuit to its left to latch itself on until switch 01 is opened;

closes switch 037 in a by-pass circuit to internal output 00 in FIG. 8 which produces, as previously explained (in connection with by-passed switch 035), actuation of cylinders 220 to advance splice roll 170 from FIG. 1 to FIG. 5 position, thus by-passing the photoelectric cell circuity set in operation by the splice switch;

closes switch 037 in the FIG. 9 by-pass circuit to internal output 07 to cause retraction of stop pins 120 as previously explained, so that a roll, if present in the working position, will roll out.

Energized internal output 402 functions as if it:

closes switch 402 in the by-pass circuit to internal output 070 which, through time delay T, turns on photocell circuit 262-260 which, in turn, causes energization of FIG. 8 internal output 020 to produce roll position forward movement of stop pins 42 by motor 66 until interposition of the new roll at position C shuts off the photocell circuit, as previously explained;

opens switch 402 in the FIG. 8 circuit to internal output 017, preventing operation of the accelerator motor 92, and closes switch 402 in the lowermost by-pass circuit on FIG. 8 through open switch 405 to internal output 03 (opening also switch 402 in the alternate by-pass circuit) so that FIG. 8 internal output 405, turned on by photocell circuit 262–260, instead of activating the accelerator motor when photocell circuit 262–260 is deactivated by roll at posiion C as in the splice sequence previously described, functions to close switch 405 in the same bottom FIG. 8 by-pass circuit to energize internal output 03 and thereby cause retraction of pins 42, so that the new roll is free to roll into contact with splice roll 170, and also functions to close switch 03 in the alternate by-pass circuit to internal output 01 of FIG. 9;

opens switch 402 in the top circuit of FIG. 9 so that internal outputs 401 and 04 and the knife and splice roll brake are not operated;

opens switch 402 in the alternate by-pass circuit to FIG. 9 internal output 07 so it does not latch on as it is simultaneously operated by the load switch as previously described:

opens switch 402 in the FIG. 9 circuit to internal output 011 so that brake 130 is not operated;

opens switch 402 in the main operating circuit of FIG. 9 internal output 06 and closes switch 402 in its alternate by-pass circuit through switch 070 closed by FIG. 8 internal output 070 so that internal output 06 is energized to cause advance of stop pins 120 to stop position;

opens switch 402 in the main operating circuit of FIG. 9 internal output 01 and closes switch 402 in its alternate by-pass circuit through switch 03, the latter switch being closed by energization of FIG. 8 internal output 03 as previously described, so that internal output 01 causes retraction of splice roll 170, this allowing the new roll to roll into working position against stop pins 120; and opening switch 01 in the FIG. 8 circuit opposite the Load switch, deenergizing internal output 402.

On retraction of the splice roll, limit switches LS031 and LS032 are effective as in the previously described splice sequence to advance stop pins 42 and operate motor 66 to retract them to starting position.

Figure 10:
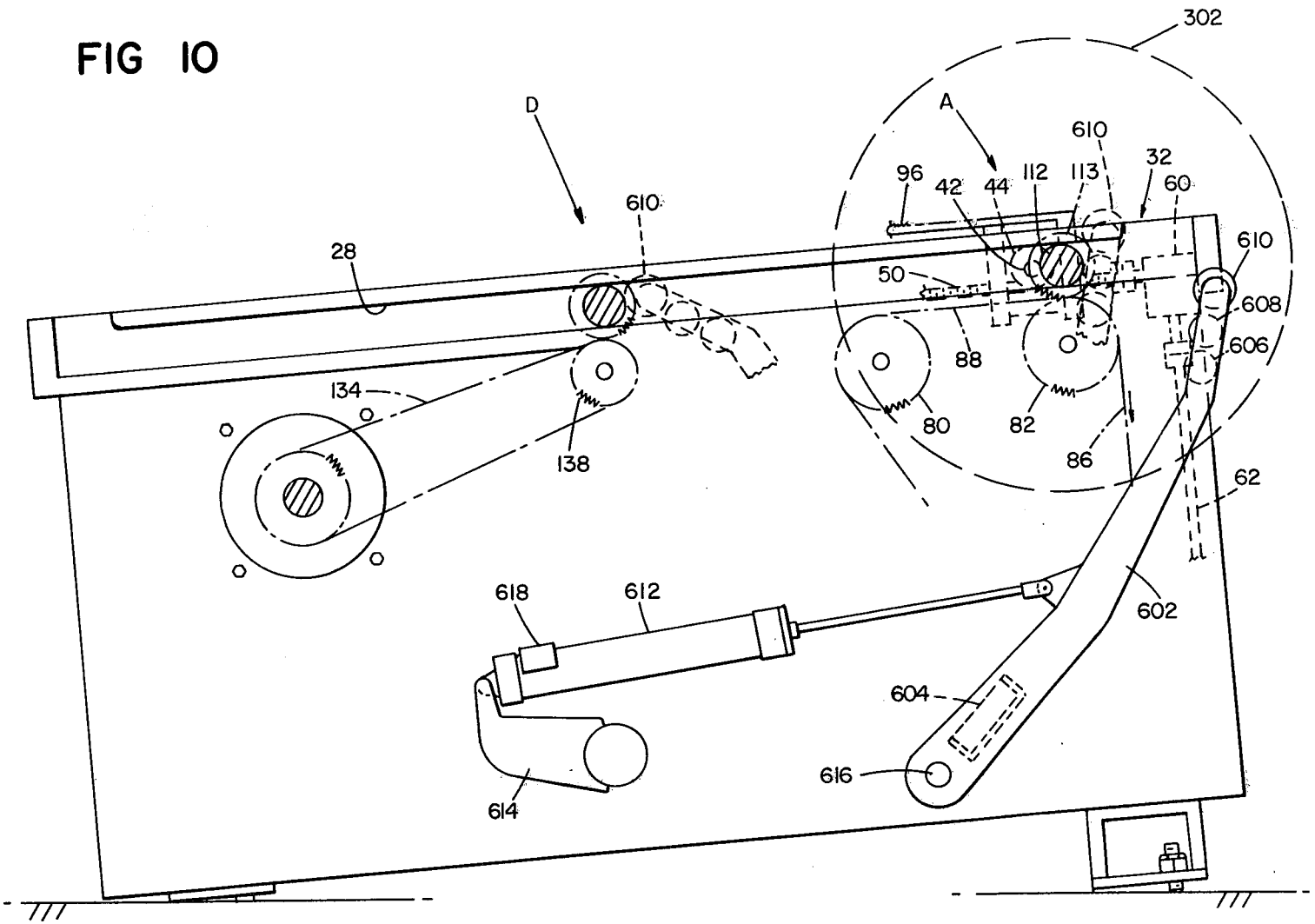
FIG. 10 is a view similar to FIG. 1 but taken along a section inside one vertical side plate and with many elements wholly or partially broken away; a roll advance mechanism is shown added to the apparatus (successive positions of advance arms being shown in dashed lines).

For lightweight rolls the 4° decline of channels 28, 30 may be insufficient to prevent chains 86 from moving mandrel 110 supporting new roll 302 away from pins 42 and back toward entrance 32 when accelerator motor 92 is activated. To correct this difficulty and improve operation with heavy rolls, as well, it is preferred that the roll advance mechanism shown in FIG. 10 be incorporated into the unwinder apparatus. It provides an assist to the gravitational force acting on new roll 302, assuring the forward advance of the roll between entrance 32 and working position D.

Two arms 602 joined by crossmember 604, each have supported on their upper ends three rollers 606, 608, 610. The rollers press against mandrel 110 at its exposed surfaces between the sides of roll 302 and sprocket wheels 113. As the mandrel progresses along channels 28, 30, different ones of the rollers engage the mandrel surface. Two penumatic cylinders 612 fastened between frame-mounted brackets 614 and arms 602 rotate the arms on frame-mounted stub shafts 616.

After a new roll 302 is inserted at entrance 32, a solenoid valve (not shown) is activated by depressing a pushbutton (not shown) to actuate cylinders 612, rotating arms 602 and rollers 606, 608, 610 into engagement with mandrel 110. The force of the rollers on the mandrel maintain it in continuous contact with pins 42 as the pins are advanced by positioning motor 66 and when accelerator motor 92 is activated. After pins 42 are retracted the rollers continue to advance the mandrel through its successive positions. When the mandrel reaches working position D, electrical limit switch 618 (integral with one of cylinders 612) is closed activating a solenoid valve (not shown) which causes the piston rods of cylinders 612 to extend, thereby returning arms 602 to their initial position.

I claim:

1. Apparatus for unwinding rolls of web material wound on mandrels, comprising means for supporting a first said roll at an unwinding station from which web material is unwound, means for supporting a second said roll at a loading station spaced from said unwinding station, transfer means for moving said second roll over a path between said stations, a new roll accelerator located between said stations for engaging the mandrel of said second roll and rotating it to a peripheral speed matching the surface speed of the web unwinding from said first roll, and means for severing the web unwinding from said first roll and splicing the severed web end to said accelerated second roll, said accelerator having a mandrel engaging element movable relative to said second roll over at least a portion of said path to rotate said second roll and to operatively engage its mandrel at a plurality of different positions of said second roll relative to said element along said path.

2. The apparatus of claim 1 wherein said path is defined by a frame.

3. The apparatus of claim 1 wherein said transfer means comprises means for moving said roll from said loading station to a transfer station located along said path, and for moving said accelerated roll to said unwinding station after said splicing, and which includes means for actuating said accelerator while said second roll is at said transfer station.

4. The apparatus of claim 1 wherein said path is linear.

5. The apparatus of claim 1 wherein said path is defined by a frame and slopes downhill so that said second mandrel can move between said stations under the force of gravity.

6. The apparatus of claim 1 wherein said path is defined by a frame which includes opposing guides having opposing channels extending along said path, and said mandrels have ends for engaging and rolling along said channels.

7. The apparatus of claim 6 wherein said mandrel ends have rollers that fit in said channels.

8. The apparatus of claim 1 wherein means are provided for accommodating a mismatch between said web speed and said peripheral speed after said splice.

9. The apparatus of claim 8 wherein said means is a clutch associated with said accelerator.

10. The apparatus of claim 1 wherein said mandrel engaging element comprises a driven sprocket chain for engaging a sprocket wheel on a said mandrel.

11. The apparatus of claim 10 wherein two said chains respectively engage two said sprocket wheels at opposite ends of said mandrel.

12. The apparatus of claim 10 wherein each said supporting means includes means for supporting the ends of said mandrels outside said sprocket wheels, for movement of said second mandrel between said stations while said sprocket wheels engage said chains over said portion of said path.

13. The apparatus of claim 5 further comprising stop means movable along said path to control the movement of said second roll, and means for retracting said stop means from said path.

14. The apparatus of claim 1 wherein said means for severing and splicing includes a splice roll movable between a retracted position and a splicing position adjacent a roll transfer station, said transfer station being between said loading and unwinding stations and extending over a portion of said path to accommodate web rolls of different diameters, and sensing means are provided to initially position said second roll at said transfer station just short of a nip with said splice roll.

15. The apparatus of claim 14 further comprising stop means to hold said second roll just short of said nip, and means to retract said stop means to permit said second roll to move against said splice roll.

16. The apparatus of claim 14 further comprising a web severing knife movable with said splice roll, and a knife actuating means permanently mounted at said splicing position.

17. The apparatus of claim 14 wherein a main tension control brake is provided at said unwinding station, and a further brake is associated with said splice roll to control web tension while said web is engaged with said splice roll before said second roll moves to said unwind station.

18. The apparatus of claim 1 further comprising means automatically responsive to the diameter of said second roll to control the speed of said accelerator.

19. The apparatus of claim 18 further comprising means for actuating said accelerator when said second roll reaches a transfer station extending over a portion of said path, and said means for controlling the speed of said accelerator is responsive to the distance travelled by said second roll along said path between said loading and transfer stations.

20. The apparatus of claim 1 wherein at least a portion of the path over which said mandrel engaging element is movable is between said loading station and the position of said second roll during splicing.

21. Apparatus for replacing rotating mandrels on which a web is wound, comprising means for supporting a first said mandrel at a main rotation station with said web material wound on said mandrel and extending therefrom, means for supporting a second said mandrel at a loading station spaced from said main station, means for providing movement of said second mandrel between said stations, comprising a stop movable along said path and means for retracting said stop from said path, an accelerator for engaging said second mandrel and rotating and accelerating it in accordance with the surface speed of the web extending from said first mandrel, and means for severing the web extending from said first mandrel and transferring the severed web end to said accelerated second mandrel.

22. The apparatus of claim 21 wherein said path is defined by a frame having portions along which said second mandrel can roll.

23. The apparatus of claim 21 further comprising means for sensing when said second mandrel is approaching said severing and transferring means, and, in response to said sensing, terminating movement of said stop along said path, and means for thereafter initiating retraction of said stop from said path.

24. Apparatus for replacing rotating mandrels on which a web is wound, comprising means for supporting a first said mandrel at a main rotation station with said web wound on said mandrel and extending therefrom, means for supporting a second said mandrel at a loading station spaced from said main station, transfer means for moving said second mandrel over a path between said stations, a new mandrel accelerator located between said stations for engaging the said second mandrel and rotating and accelerating it in accordance with the surface speed of the web extending from said first mandrel, means for severing the web extending from said first mandrel and transferring the severed web end to said accelerated second mandrel, including a splice roll movable between a retracted position and a transfer position adjacent a mandrel stop station, said stop station being between said loading and main rotation stations, and sensing means to initially position said second mandrel at said stop station just short of the transfer position of said splice roll.

25. The apparatus of claim 24 wherein said main rotation station is an unwinding station from which a first roll of said web on said first mandrel is unwound, said second mandrel carries a second roll of said web, and said stop station is just short of nip of said second roll with said splice roll.

26. The apparatus of claim 25 further comprising stop means to hold said second roll at said stop position, and means to retract said stop means to permit said second roll to move against said splice roll.

27. Apparatus for unwinding rolls of web material wound on mandrels, comprising means for supporting a first said roll at an unwinding station from which web material is unwound, means for supporting a second said roll at a loading station spaced from said unwinding station, transfer means for moving said second roll over a path between said stations, a new roll accelerator for engaging said second roll and rotating it to a peripheral speed matching the surface speed of the web unwinding from said first roll, and means for severing the web unwinding from said first roll and splicing the severed web end to said accelerated second roll, said means for severing and splicing including a splice roll movable between a retracted position and a splicing position, a main tension control brake being provided at said unwinding station, and a further brake being associated with said splice roll to control web tension while said web is engaged with said splice roll and said second roll moves to said unwind station.

28. Apparatus for unwinding rolls of web material wound on mandrels, comprising means for supporting a first said roll at an unwinding station at which web material is unwound from said roll, and for supporting a second said roll at a loading station spaced from said unwinding station, means for moving said second roll along a path between said stations, a new roll accelerator for engaging said second roll and accelerating it to match the peripheral speed of said second roll to the surface speed of the web unwinding from said first roll, means for severing the web unwinding from said first roll and splicing the severed web end to said accelerated second roll, and means automatically responsive to the diameter of said second roll to control the speed of said accelerator.

29. The apparatus of claim 28 further comprising means for actuating said accelerator when said second roll reaches a transfer station extending over a portion of said path, and said means for controlling the speed of said accelerator is responsive to the distance travelled by said second roll along said path between said loading and transfer stations.

* * * * *